US009412576B2

(12) United States Patent
Kim et al.

(10) Patent No.: US 9,412,576 B2
(45) Date of Patent: Aug. 9, 2016

(54) ION TRAP MASS SPECTROMETER USING COLD ELECTRON SOURCE

(71) Applicant: KOREAN BASIC SCIENCE INSTITUTE, Daejeon (KR)

(72) Inventors: Seung Yong Kim, Daejeon (KR); Mo Yang, Daejeon (KR); Hyunsik Kim, Daejeon (KR)

(73) Assignee: KOREA BASIC SCIENCE INSTITUTE (KR)

( * ) Notice: Subject to any disclaimer, the term of this patent is extended or adjusted under 35 U.S.C. 154(b) by 0 days.

(21) Appl. No.: 14/558,283

(22) Filed: Dec. 2, 2014

(65) Prior Publication Data

US 2015/0162178 A1 Jun. 11, 2015

(30) Foreign Application Priority Data

Dec. 5, 2013 (KR) ..... 10-2013-015088

(51) Int. Cl.

| | |
|---|---|
| ***H01J 49/14*** | (2006.01) |
| ***H01J 27/20*** | (2006.01) |
| ***H01J 49/08*** | (2006.01) |

(52) U.S. Cl.

CPC ..... *H01J 49/147* (2013.01); *H01J 27/205* (2013.01); *H01J 49/08* (2013.01)

(58) Field of Classification Search

CPC ..... H01J 49/08; H01J 49/147; H01J 49/42

See application file for complete search history.

(56) References Cited

U.S. PATENT DOCUMENTS

2005/0161595 A1* 7/2005 Cotter ..... 250/290

OTHER PUBLICATIONS

Kim et al. 'Cold Electron Source with an Electron Multiplier Illuminated by Ultraviolet Photons' Apr. 17, 2012, Anal Chem vol. 84, #8, pp. 3635-3639.*

* cited by examiner

*Primary Examiner* — Robert Kim
*Assistant Examiner* — Eliza Osenbaugh-Stewar
(74) *Attorney, Agent, or Firm* — Weiss & Moy, P.C.; Jeffrey D. Moy

(57) ABSTRACT

The present invention relates to an ion trap mass spectrometer using a cold electron source, in a production of a portable mass spectrometer, in which a microchannel plate (MCP) module is used, initial electrons are induced by injecting ultraviolet photons emitted from an ultraviolet diode to a front surface of the MCP module, electron beams amplified from the electrons are amplified using a channeltron electron multiplier (CEM), the amplified electron beams are accurately adjusted and injected into an ion trap, thus increasing the amplification rate, and since a quadrupole field is used as an ion filter which returns the initially injected electrons to the inside of an ion trap mass separator, the ionization rate increases.

12 Claims, 2 Drawing Sheets

ION TRAP MASS SPECTROMETER USING COLD ELECTRON SOURCE

CROSS-REFERENCE TO RELATED APPLICATION

This application claims priority to and the benefit of Korean Patent Application No. 2013-0150883, filed on Dec. 5, 2013, the disclosure of which is incorporated herein by reference in its entirety.

BACKGROUND

1. Field of the Invention

The present invention relates to an ion trap mass spectrometer, and more particularly, to an ion trap mass spectrometer using a cold electron source, in which cold electrons are produced at room temperature using an ultraviolet light emitting diode (UV LED), a microchannel plate (MCP) electron multiplier plate, and a channeltron electron multiplier (CEM), without using a thermionic source using a filament, and are applied to the mass spectrometer.

2. Discussion of Related Art

Generally, in a mass spectrometer, a process of ionizing gaseous molecules is required first to separate molecular ions according to masses of molecular ions and analyze components.

A method of ionizing gaseous molecules by bombarding with an electron beam is most frequently used. To produce the electron beam, a device for heating a filament at a high temperature to induce thermionic emission is most widely used.

The filament may be heated at a high temperature by flowing high current through a high-temperature metal such as tungsten or rhenium. However, due to high power consumption, battery power is rapidly consumed in a portable mass spectrometer. Further, a reaction of electron emission caused by a high temperature increase is slow, and thus the device using the filament is difficult to control in a mass spectrometer which is suitable to produce a continuous output electron beam and requires pulse ionization within a short time.

SUMMARY OF THE INVENTION

Accordingly, the present invention is directed to providing a mass spectrometer using a cold electron source, in a production of a portable mass spectrometer, in which a microchannel plate (MCP) electron multiplier plate is used, a front surface of the MCP electron multiplier plate is injected with ultraviolet photons emitted from an ultraviolet diode to induce initial electron emission, electron beams amplified from the electrons are amplified using a channeltron electron multiplier (CEM), the amplified electron beams are accurately adjusted and injected into an ion trap, and thus an amplification rate increases, since a quadrupole field is used as an ion filter, initially injected electrons return to the inside of the ion trap mass separator, and thus an ionization rate increases.

According to an aspect of the present invention, there is provided an ion trap mass spectrometer using a cold electron source, which uses a device configured to acquire an ionization source using a microchannel plate (MCP) and a channeltron electron multiplier (CEM), in which ultraviolet photons radiated from an inside of a mass spectrometer vacuum chamber in a high vacuum state induce initial electron emission, and gaseous molecules are ionized through an electron beam obtained by amplifying the electrons and ions are detected, the ion trap mass spectrometer including an ultraviolet diode which emits ultraviolet rays to the inside of the mass spectrometer vacuum chamber; an MCP module which induces initial electron emission of ultraviolet photons emitted from the ultraviolet diode, amplifies the emitted electrons, and obtains electron beams from a back plate; a CEM module which amplifies the electron beam emitted from the MCP module, and obtains electron beams in quantity; an electron focusing lens which focuses the electron beam amplified through the CEM module; an ion trap mass separator which ionizes the gaseous sample molecules and traps the gaseous sample molecules in a certain space using the electron beams injected through the electron focusing lens; an ion filter which prevents a loss of electrons when electron beams injected through the electron focusing lens pass through the ion trap mass separator and proceed; and an ion detector which detects ions separated from the ion trap mass separator based on a mass spectrum.

The MCP module injects ultraviolet photons emitted in quantity from the ultraviolet diode to a front plate of the MCP, the ultraviolet photons induce initial electron emission in quantity, the CEM module is configured to include an ionization source CEM front electrode and an ionization source CEM back electrode, and obtains highly-amplified electron beams by injecting the electron beam amplified at a back plate of the MCP.

The ion trap mass separator is injected with ionization sources including an ionization source to ionize the gaseous sample, ionized ions are trapped by a trapping RF voltage, and sequentially includes a mass separator front electrode, a mass separator RF electrode, and a mass separator back electrode.

The ion filter is configured to include a mass separator back electrode of the ion trap mass separator, a quadrupole field ion filter electrode, and an exit electrode.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Exemplary embodiments of the present invention will be described in detail below with reference to the accompanying drawings. While the present invention is shown and described in connection with exemplary embodiments thereof, it will be apparent to those skilled in the art that various modifications can be made without departing from the spirit and scope of the invention.

An ion trap mass spectrometer using a cold electron source according to an embodiment of the present invention will be described in conjunction with the accompanying drawings as follow.

Figure 1:
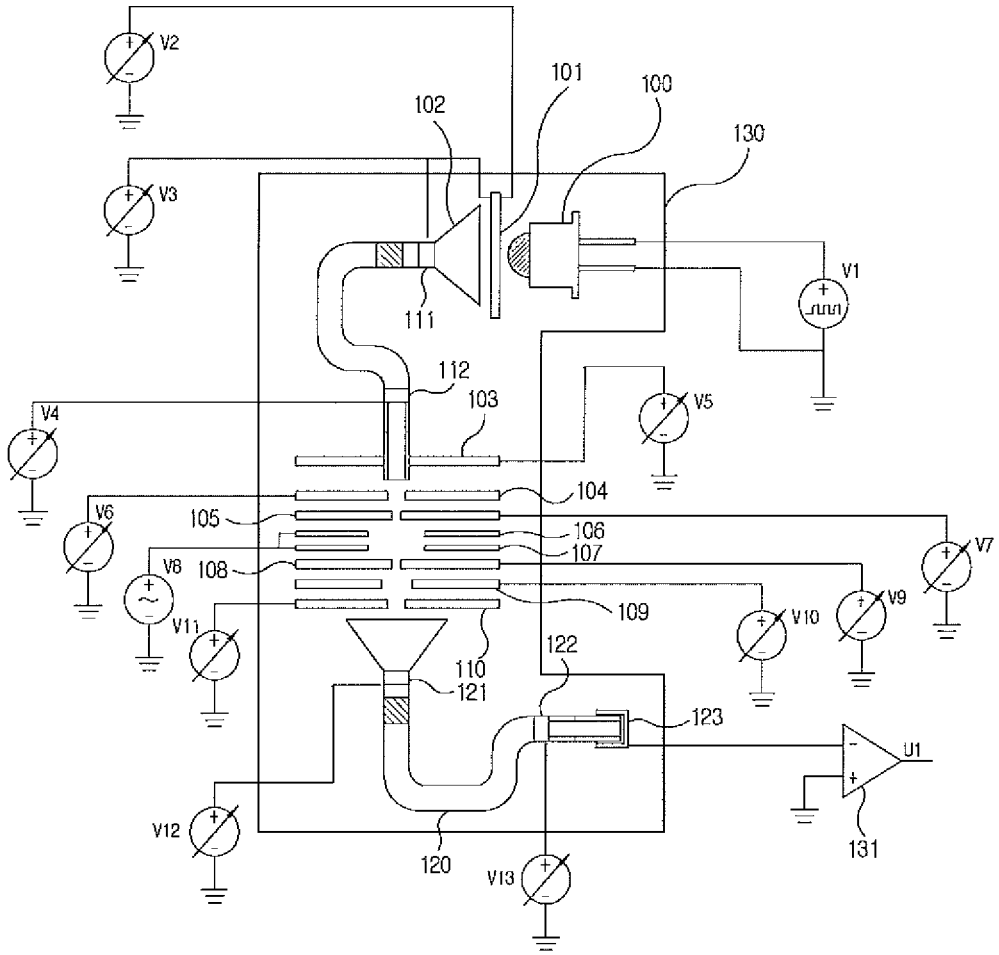
FIG. 1 is a circuit configuration diagram of an ion trap mass spectrometer using a cold electron source according to an embodiment of the present invention.

FIG. 1 is a configuration diagram of ion trap mass spectrometer using a cold electron source according to an embodiment of the present invention, including an ultraviolet diode 100 which emits ultraviolet rays by supplying a power source, an MCP module 101 whose back plate obtains electron beams in quantity by inducing initial electron emission of ultraviolet photons from the ultraviolet diode 100 and amplifying the emitted electrons, a funnel-shaped CEM module 102 which obtains electron beams in quantity by amplifying electron beams passing through the MCP module 101, an entrance electrode 103 which focuses amplified electron beams input from the CEM module 102 and injects ions, an electron focusing lens 104 which focuses the injected electrons, ion trap mass separators 105, 106, 107, and 108 which ionize gaseous sample molecules using electron beams injected through the electron focusing lens 104, an ion detector 120 which detects ions separated from the ion trap mass separators 105, 106, 107, and 108 based on a mass spectrum, and a preamplifier 131 which amplifies a current signal detected through an ion signal detection electrode of the ion detector 120.

The ultraviolet diode 100 radiates photons after receiving a pulse voltage having a constant current value through a voltage source V1.

The MCP module 101 is configured such that a voltage in a range of −2800 to −4000 V V2 is applied to an MCP front plate 101*a* and ultraviolet photons radiated from the ultraviolet diode 100 are irradiated, an identical direct current (DC) voltage in a range of −2000 to −3000 V V3 is applied to an MCP back plate 101*b* together with an ionization source CEM front electrode 111 of a CEM module 102 to amplify ultraviolet photons radiated from the MCP front plate 101*a* of the MCP module 101.

The CEM module 102 includes the ionization source CEM front electrode 111 and an ionization source CEM back electrode 112.

The ion trap mass separators 105 to 108 sequentially include a mass separator front electrode 105, mass separator RF electrodes 106 and 107, and a mass separator back electrode 108 from a back end of the electron focusing lens 104.

The ion filters 108 to 110 include the mass separator back electrode 108 of the ion trap mass separators 105 to 108, a quadrupole field ion filter electrode 109, and an exit electrode 110, and the mass separator back electrode 108 is shared in the ion filters.

The ion detector 120 is formed as a channeltron electron multiplier (CEM) module in which ions passing through the ion filters 108 to 110 are detected and amplified, and includes a CEM front electrode 121 for detecting ions, a CEM back electrode 122 for detecting ions, and an ion signal detection electrode 123.

The ion filters 108 to 110 include quadrupole field ion filters 108, 109, and 110 which serve to return initially injected ions to the ion trap mass separator without passing through the quadrupole field ion filter electrode 109 after passing through the ion trap mass separators 105, 106, 107, and 108.

Each of the components 100 to 123 of the mass spectrometer operates in a vacuum chamber 130 having a pressure in a range of $10^{-4}$ to $10^{-10}$ Torr.

With regard to an action of the above-described ion trap mass spectrometer using a cold electron source according to the embodiment of the present invention, detailed descriptions are described with reference to FIGS. 1 to 3 as follows.

In the embodiment of the present invention, ultraviolet photons induce initial electron emission at the ultraviolet diode first, the emitted electrons are amplified to radiate electron beams, the radiated electron beams are focused by the electron focusing lens, and then gaseous sample molecules are ionized in the ion trap mass analyzer and the separated ions are detected by the ion detector.

Figure 2:
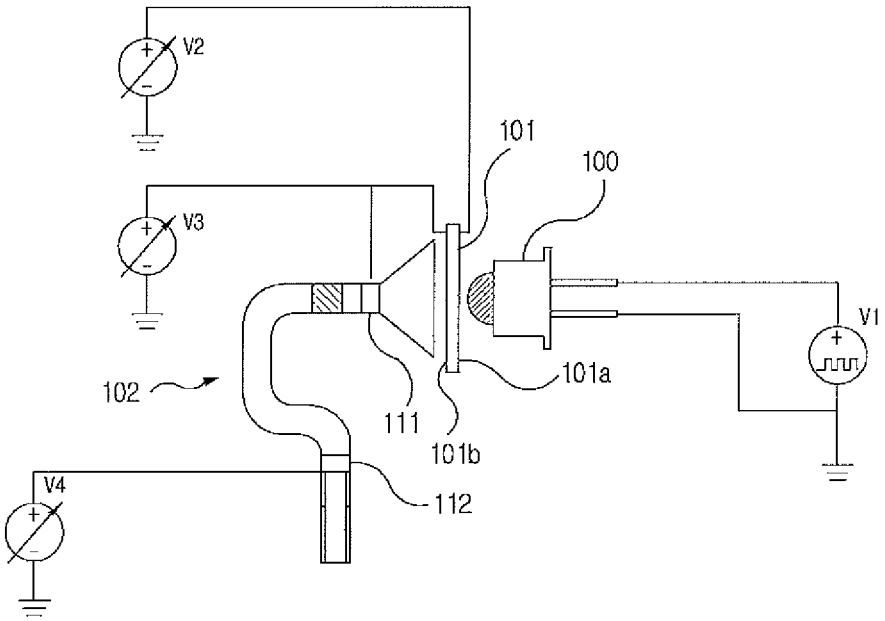
FIG. 2 is a configuration diagram of a source module only formed as an ionization source of a cold electron source in FIG. 1.

FIG. 1 is a circuit configuration diagram of the ion trap mass spectrometer using a cold electron source according to an embodiment of the present invention, and FIG. 2 is a separate configuration diagram of a cold electron ionization source.

In the vacuum chamber 130, the MCP front plate 101*a* of the MCP module 101 is injected with ultraviolet rays emitted from the ultraviolet diode 100, the ultraviolet photons induce initial electron emission in quantity at the MCP front and back plates 101*a* and 101*b*.

Initially emitted electrons generated in quantity when the ultraviolet rays pass through the MCP front and back plates 101*a* and 101*b* are injected into a funnel-shaped inlet in the CEM module 102, and thereby a further highly-amplified electron beam may be obtained.

Here, a negative voltage in a range of −2800 to −4000 V V2 is applied to the MCP front plate 101*a*, a negative voltage in a range of −2000 to −3000 V V3 is applied to the MCP back plate 101*b* in conjunction with the CEM electrode 111, a voltage in a range of −200 to 0 V V4 is applied to the CEM electrode 112, and thereby, highly amplifying the injected ultraviolet rays.

The electron beams amplified by the CEM module 102 are injected without loss by a voltage in a range of −100 to 0 V V5 which is applied to the entrance electrode 103, and focused in one direction by the electron focusing lens 104, and then injected into the ion trap mass separators 105, 106, 107, and 108 to ionize the gaseous sample molecules.

Here, the ionization is adjusted by an ultraviolet emission time and an amount of current of the ultraviolet diode 100. That is, the ionization is adjusted by an on/off pulse signal of a voltage source V1 driving the ultraviolet diode 100. When the on pulse signal is applied for a long time, a large quantity of the ultraviolet ray is emitted. When the on pulse signal is applied for a short time, a small quantity of the ultraviolet ray is emitted.

Further, to adjust an intensity of the ultraviolet diode 100, an amount of the emitted ultraviolet photons is adjusted by adjusting an amount of current of the ultraviolet diode, and thereby accurately and momentarily obtaining an electron current required for gas ionization in the mass spectrometer.

A negative voltage V6 is applied to the electron focusing lens 104 to focus ultraviolet photons emitted from the cold electron ionization modules 100, 101, and 102 which include the ultraviolet diode 100, the MCP module 101, and the CEM module 102. A voltage higher than the negative voltage V3 applied to the MCP back plate 101*b* of the MCP module 101 is applied to the electron focusing lens 104, the same voltage V3 as that of the ionization source CEM front electrode 111 is applied to the MCP back plate 101*b* of the MCP module 101 V3, and a voltage lower than that applied to the ionization source CEM back electrode 112 is applied to the MCP back plate 101*b* of the MCP module 101.

The ion trap mass separators 105 to 108 are injected with the ionization sources including the ionization source, and ions which are ionized while colliding with electrons are trapped by a trapping RF voltage.

More specifically, the ion trap mass separators 105 to 108 separate gaseous samples into ions using electron beams passing through the electron focusing lens 104, and the ion detector 120 detects the ions generated in the ion trap mass separators 105 to 108, and the detected ions are detected as signals based on a principle of the ion trap mass analyzer.

To transmit ions generated in the ion trap mass separators 105 to 108 to the ion detector 120, an RF voltage V8 is applied to the mass separator RF electrodes 106 and 107.

As the RF voltage applied to the RF electrodes 106 and 107 increases, ions are separated from the ion trap mass separator and detected by the ion detector corresponding to the RF voltage proportional to a mass value.

Figure 3:
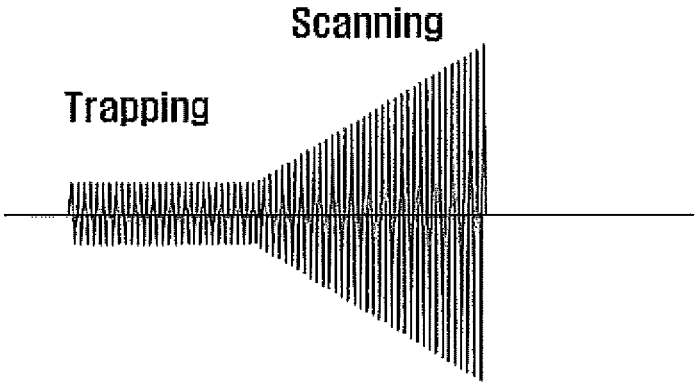
FIG. 3 is a waveform diagram of an RF signal applied to a mass separator RF electrode in FIG. 2.

Here, as shown in FIG. 3, the RE voltage V8 is a high frequency signal having a certain voltage to trap ions, and the voltage which gradually increases is applied to detect ions.

An interaction equation of the voltage and mass is the following Equation 1. When a frequency (Ω) is a fixed value, and a voltage value which is proportional to a mass value increases, ions having the corresponding mass value are detected at the outside of the ion trap mass separators 105 to 108.

$$m = -\frac{8\ \text{eV}}{q_z r^2 \Omega^2} \qquad \text{[Equation1]}$$

Each electrode of the ion filters 108, 109, and 110 which serve as quadrupole field ion filters is present at the back end of the ion trap mass separators 105 to 108, and returns the electrons initially injected by the electrodes into the inside of the ion trap mass separator without escaping to the outside, thus increasing the ionization rate.

That is, the ion filter electrode 109 is formed as a quadrupole field ion filter electrode, which prevents a secondary ionization at the outside of the ion trap mass separator when electrons proceed after passing through the ion trap mass separators 105 to 108.

For the ion filters 108 to 110 to serve as quadrupole field ion filters, the mass separator back electrode 108 and exit electrode 110 are grounded V9 and V11, and the ion filter electrode 109 has a negative voltage value V10.

The ion detector 120 is formed as a CEM electron multiplier, for a normal operation of the CEM, a voltage in a range of −2000 to −300 V V12 is applied to the CEM front electrode 121 for detecting ions, a voltage in a range of −300 to 0 V V13 is applied to the CEM back electrode 122 to amplify the detected ions, and thereby an ion signal is obtained through the ion signal detection electrode 123.

A current signal sensed by the ion signal detection electrode 123 is amplified to have the analyzable signal intensity through the preamplifier 131, and thereby an ion signal is detected.

As described above, the device for acquiring an ionization source of a mass spectrometer using an MCP, a CEM according to the embodiment of the present invention can be applied to a low temperature electron gun required for portable small devices, low power devices, or devices in which a low temperature is maintained, or to devices generating and using electron beams As described above, the ion trap mass spectrometer using a cold electron source can provide electron beams to ionize gaseous molecules at a low temperature, without using a high temperature and high current. The ion trap mass spectrometer provides a necessary amount of electron beams when needed, and thus a size and weight of the mass spectrometer can be decreased when applied to a small mass spectrometer, and since a battery power can be saved, the ion trap mass spectrometer can be effectively applied as a portable mass spectrometer. Further, thin electron beams can be emitted, and thus the electron beams can be easily focused. Furthermore, the quadrupole field ion trap mass spectrometer using the cold electron source can improve a performance of analyzing mass by including the quadrupole field ion filter.

Although specific embodiments of the present invention have been described here, it will be apparent to those skilled in the art that various modifications can be made to the above-described ion trap mass spectrometer using a cold electron source without departing from the spirit or scope of the invention.

Thus, it is intended that the present invention covers all such modifications provided they come within the scope of the appended claims and their equivalents.

What is claimed is:

1. An ion trap mass spectrometer using a cold electron source, which uses a device configured to acquire an ionization source using an microchannel plate (MCP) and a channeltron electron multiplier (CEM), in which ultraviolet photons radiated from an inside of a mass spectrometer vacuum chamber in a high vacuum state induce initial electron emission, gaseous molecules are ionized through an electron beam obtained by amplifying the electrons, and ions are detected, the ion trap mass spectrometer comprising:

an ultraviolet diode which emits ultraviolet rays to the inside of the mass spectrometer vacuum chamber;

an MCP module which induces initial electron emission of ultraviolet photons emitted from the ultraviolet diode, amplifies the emitted electrons, and obtains an electron beam at a back plate, wherein a voltage in a range of −2800 to −4000V is applied to a front plate, and an identical voltage in a range of −2000 to −3000 V is applied to the back plate together with a front electrode of a CEM module;

a CEM module which amplifies the electron beam emitted from the MCP module, and obtains an electron beam in quantity;

an electron focusing lens which is horizontally arranged in parallel to an ion trap mass separator fron electrode and focuses the electron beam amplified through the CEM module;

an ion trap mass separator which sequentially includes a front electrode, an RF electrode, and a back electrode, and ionizes the gaseous sample molecules using the electron beam injected through the electron focusing lens, and captures the ionized gaseous sample molecules in a certain space;

an ion filter including a mass separator back electrode of the ion trap mass separator, a quadrupole field ion filter electrode, which prevents a secondary ionization at the outside of the ion trap mass separator when electrons proceed after passing through the ion trap mass separators, and an exit electrode, the ion filter preventing a loss of electrons by forming a quadrupole field when the electron beam injected through the electron focusing lens passes through the ion trap mass separator and proceeds; and an ion detector which detects ions separated from the ion trap mass separator based on a mass spectrum, wherein each of the components is provided in a vacuum chamber having a pressure in a range of $10^{-4}$ to $7\times10^{-7}$ Torr.

2. The ion trap mass spectrometer of claim 1, wherein an ultraviolet emission time and intensity are adjusted according to an on/off pulse signal of the ultraviolet diode.

3. The ion trap mass spectrometer of claim 1, wherein the MCP module injects ultraviolet photons emitted in quantity from the ultraviolet diode to a front plate of the MCP, the ultraviolet photons induce initial electron emission in quantity, and the CEM module obtains a highly-amplified electron beam by injecting the electron beam amplified at a back plate of the MCP.

4. The ion trap mass spectrometer of claim 1, wherein the CEM module is configured to include an ionization source CEM front electrode and an ionization source CEM back electrode.

5. The ion trap mass spectrometer of claim 1, wherein a voltage higher than a negative voltage applied to a back plate of the MCP is applied to the electron focusing lens, the same voltage as a voltage of a CEM front electrode is applied to the back plate of the MCP, and a voltage lower than a negative voltage applied to a CEM back electrode is applied to the back plate of the MCP.

6. The ion trap mass spectrometer of claim 1, wherein the ion trap mass separator is injected with ionization sources including an ionization source to ionize a gaseous sample, and ionized ions are trapped by a trapping RF voltage.

7. The ion trap mass spectrometer of claim 1, wherein an RF voltage gradually increases in the ion trap mass separator, ions are separated from the ion trap mass separator, and detected by the ion detector according to an RF voltage which is proportional to a mass value.

8. The ion trap mass spectrometer of claim 1, wherein the ion trap mass separator sequentially includes a mass separator front electrode, a mass separator RF electrode, and a mass separator back electrode.

9. The mass spectrometer of claim 1, wherein the ion filter is configured to include a mass separator back electrode of the ion trap mass separator, a quadrupole field ion filter electrode, and an exit electrode.

10. The mass spectrometer of claim 1, wherein the ion detector is formed as a channeltron electron multiplier (CEM) module which detects and amplifies ions passing through the ion filter.

11. The mass spectrometer of claim 10, wherein the ion detector is configured to include a CEM front electrode configured to detect ions, a CEM back electrode configured to detect ions, and an ion signal detection electrode.

12. The mass spectrometer of claim 11, wherein the ion detector further includes a preamplifier which amplifies a current signal detected through the ion signal detection electrode.

* * * * *